United States Patent [19]

Shibuya

[11] 4,104,010

[45] Aug. 1, 1978

[54] ROTARY COMPRESSOR COMPRISING IMPROVED ROTOR LUBRICATION SYSTEM

[75] Inventor: Tsunenori Shibuya, Konan, Japan

[73] Assignee: Diesel Kiki Co. Ltd., Tokyo, Japan

[21] Appl. No.: 715,025

[22] Filed: Aug. 17, 1976

[30] Foreign Application Priority Data

Aug. 18, 1975 [JP] Japan ..... 50-113520[U]

[51] Int. Cl.[2] ..... F04C 29/02

[52] U.S. Cl. ..... 418/76; 418/82; 418/268

[58] Field of Search ..... 418/76, 81, 82, 96, 418/268

[56] References Cited

U.S. PATENT DOCUMENTS

| | | | |
|---|---|---|---|
| 3,480,204 | 11/1969 | Harlin | 418/82 |
| 3,598,510 | 8/1971 | Aoki | 418/82 X |

*Primary Examiner*—Carlton R. Croyle
*Assistant Examiner*—Leonard Smith
*Attorney, Agent, or Firm*—Frank J. Jordan

[57] ABSTRACT

A rotor is eccentrically mounted in a bore of a housing and formed with radial slots in which vanes are slidably retained. The vanes partition the bore into a plurality of fluid chambers which increase in volume in an inlet portion of the bore and decrease in volume in an outlet portion of the bore upon rotation of the rotor. An inlet opens into the inlet portion of the bore and an outlet leads from the outlet portion of the bore. An oil sump provided at the bottom of the housing is connected to the outlet and pressurized thereby. An end plate of the housing is formed with a semi-annular high pressure oil groove in the outlet portion of the bore and a semi-annular low pressure oil groove in the low pressure portion of the bore which communicate with the slots radially inwardly of the vanes so that oil in the slots urges the vanes into sealing engagement with the wall of the bore. The high pressure oil groove communicates with the oil sump and the low pressure oil groove communicates with the inlet, with the high and low pressure oil grooves being connected by a flow restriction passageway providing a pressure drop therebetween. The force of the oil urging the vanes radially outwardly is thereby greater in the outlet portion of the bore than in the inlet portion of the bore to compensate for the higher working fluid pressure in the outlet portion than in the inlet portion in such a manner that the pressing force between the vanes and the wall of the bore is the same in the inlet and outlet portions.

2 Claims, 4 Drawing Figures

ROTARY COMPRESSOR COMPRISING IMPROVED ROTOR LUBRICATION SYSTEM

BACKGROUND OF THE INVENTION

The present invention relates to a rotary compressor which may be advantageously employed in an air conditioning system of an automotive vehicle for compressing a refrigerant fluid.

Rotary compressors are well known in the art which comprise a housing formed with a bore, fluid inlets and outlets communicating with the bore and a rotor mounted in the bore in such a manner that rotation thereof causes a working fluid such as a refrigerant to be compressively displaced from the inlet to the outlet. The rotor is typically provided with radial slots and vanes which are slidable retained in the slots and urged into sealing engagement with the inner wall of the bore. The rotor is eccentrically or similarly disposed in the bore in such a manner that upon rotation of the rotor the vanes divide the bore into fluid chambers of progressively varying volume. The compressor is designed so that the fluid chambers increase in volume in the vicinity of the inlet and decrease in volume in the vicinity of the outlet so that the fluid is sucked into the fluid chambers through the inlet and discharged therefrom through the outlet at elevated pressure. Due to the sealing effect of the vanes the compressor operates on the positive displacement principle.

A unique method has recently been devised to lubricate the rotor without the provision of a separate oil pump. An oil sump is provided below the compressor housing which communicates with the fluid outlet. In this manner, the oil in the oil sump is subjected to the output pressure of the fluid. An oil passageway leads from the oil sump to the inner portion of the rotor and to the fluid inlet in such a manner that oil is forced from the pressurized oil sump to the interior of the rotor and the low pressure fluid inlet.

The rotor comprises a drive shaft and a rotor body fixed to the shaft, the vane slots being formed in the rotor body. The oil passageway leads to the radially inner portions of the vane slots between the vanes and the shaft so that the pressurized oil not only lubricates the areas of sliding contact between the vanes and the walls of the respective slots but also urges the vanes radially outwardly into sealing engagement with the inner wall of the bore.

The oil is sucked along with the working fluid into the fluid chambers in the bore and lubricates the areas of sliding contact between the outer ends of the vanes and the wall of the bore. At the fluid outlet, the oil is separated from the working fluid and returned to the oil sump.

Although a compressor having this configuration is effective and efficient in operation and enables a substantial reduction in component parts over a compressor which comprises a separate forced feed oil pump, a problem exists in the basic design in that the vanes are urged into sealing engagement with the wall of the bore with a greater force in the inlet portion of the bore than in the outlet portion thereof. This is because the working fluid or refrigerant pressure in the inlet portion is below atmospheric whereas the pressure in the outlet portion is substantially above atmospheric due to the action of the compressor. The radially outward urging force applied to the vanes must be sufficient to prevent working fluid from blowing past the vanes in the tangential direction and overcome the inward force of the working fluid in the radial direction in the outlet portion of the bore. If the same radially outward urging force is applied to the vanes in the inlet portion of the bore, which is the case in the basic design, the pressure between the vanes and the wall of the bore is greater in the inlet portion than in the outlet portion. This is because the pressure is below atmospheric in the inlet portion and the working fluid does not urge the vanes radially inwardly against the pressure of the oil in the slots as is the case in the outlet portion. The pressure between the vanes and the wall of the bore is therefore excessive in the inlet portion.

As a natural consequence of this action, the friction is excessive in the inlet portion which causes premature wear of the vanes and bore wall. In addition, the torque required to rotatably drive the rotor is excessive requiring an unnecessarily large motor and a large flywheel to overcome the large variation in torque effort.

SUMMARY OF THE INVENTION

It is therefore an object of the present invention to provide a rotary compressor in which the pressure between vanes and an inner wall of a housing bore is the same in inlet and outlet portions of the bore.

It is another object of the invention to provide a rotary compressor with reduced torque drive requirements and reduced torque effort fluctuation.

It is another object of the present invention to provide a rotary compressor in which wear of vanes and bore wall is reduced.

It is another object of the present invention to provide a rotary compressor in which vanes are urged into sealing engagement with a bore inner wall by oil pressure in radially inner portions of slots in which the vanes are slidably retained, the oil pressure applied to the slots being higher in an inlet portion of the bore than in an outlet portion thereof.

It is another object of the present invention to provide a generally improved rotary compressor.

Other objects, together with the foregoing, are attained in the embodiment of the present invention described in the following description and shown in the accompanying drawings.

DESCRIPTION OF THE PREFERRED EMBODIMENT

Figure 1:
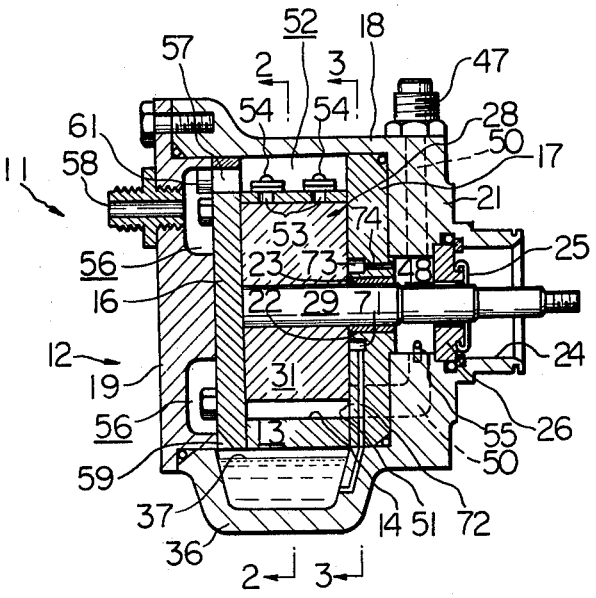
FIG. 1 is a longitudinal sectional view of a rotary compressor embodying the present invention.

While the rotary compressor of the present invention is susceptible of numerous physical embodiments, depending upon the environment and requirements of use, substantial numbers of the herein shown and described embodiment have been made, tested and used, and all have performed in an eminently satisfactory manner.

Referring now to the drawing, a rotary compressor 11 embodying the present invention comprises a housing which is generally designated as 12. The housing 12 comprises a cylinder 13 which is formed with a bore 14.

The left and right ends (as viewed in FIG. 1) of the cylinder 13 are closed by end plates 16 and 17 respectively. The assembly comprising the cylinder 13 and end plates 16 and 17 is supported within a generally cylindrical shell 18. A left end cover 19 and a right end cover 21 which is integral with the shell 18 fixedly engage with the end plates 16 and 17 respectively.

The end plate 17 is formed with an opening 22 in which is fitted a rolling contact bearing 23. The right end cover 21 is formed with an opening 24 in which is fitted a bearing 26. The bearing 26 is provided with an oil seal 25 to prevent passage of oil therethrough.

Figure 2:
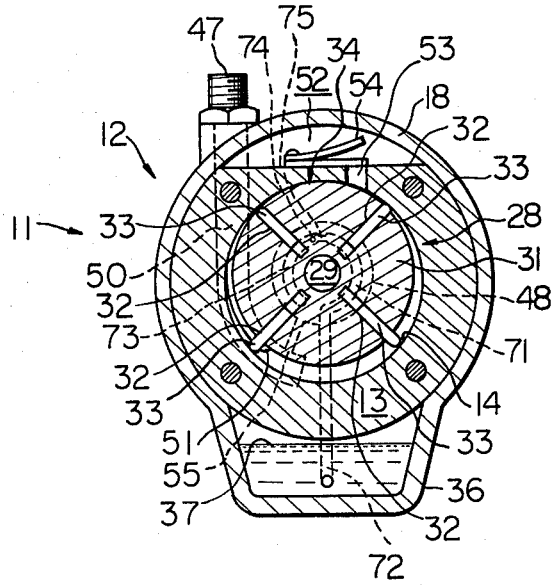
FIG. 2 is a sectional view of the compressor shown in FIG. 1 taken on a line 2—2.

A rotor which is generally designated as 28 comprises a drive shaft 29 which is rotatably supported by the bearings 23 and 26. A rotor body 31 is fixed to the shaft 29 for unitary rotation and is formed with radial slots 32 which are shown most clearly in FIG. 2. Vanes 33 are radially slidingly retained in the slots 32 respectively and engage with the inner wall (not designated) of the bore 14.

Although any number of slots 32 and vanes 33 may be provided, the number shown is four each which are circumferentially spaced at intervals of 90°. The cylinder 13, rotor body 31, slots 32 and vanes 33 are coextensive in such a manner that the rotor body 31 and vanes 33 sealingly engage with the end walls 16 and 17. Although various configurations may be provided for the cross-sections of the bore 14 and rotor body 31, the compressor 11 operates in an extremely effective manner if said sections are circular, with the diameter of the bore 14 being greater than the diameter of the rotor body 31. The rotor body 31 is furthermore coaxial with the shaft 29 and sealingly tangent to the inner wall of the bore 14 at the uppermost point thereof, designated as 34. It is clear that the openings 22 and 24 in the end plate 17 and end cover 21 as well as the bearings 23 and 26 and shaft 29 are mutually coaxial and are eccentric relative to the central axis of the bore 14.

Where the compressor 11 is employed to circulate a refrigerant fluid in an automotive air conditioning system, a fluid inlet port 47 is connected to an evaporator unit (not shown). The inlet port 47 communicates through an inlet passageway 50 and connecting passageway 55 with an oil chamber 48 in the end cover 21 between the end plate 17 and bearing 26. As best viewed in FIG. 2, a generally crescent shaped inlet orifice 51 leads from the inlet passageway 50 into the bore 14. The upper portion of the cylinder 13 is cut away to form an outlet passageway 52, which communicates with the bore 14 through outlet orifices 53. Check valves 54 are provided at the outlet orifices 53 respectively to prevent reverse flow through the compressor 11. The left end cover 19 is formed with an annular outlet chamber 56 which communicates with the outlet passageway 52 through a passageway 57 formed through the end plate 16, which constitutes an extension of the outlet passageway 52, and an oil separator 61. The outlet chamber 56 is connected through an outlet port 58 to a condenser (not shown) of the air conditioning system and communicates with an oil sump 36 through a communicating passageway 59 formed through the end wall 16.

The vanes 33 partition the bore 14 into four fluid chambers (not designated) in conjunction with the rotor body 31, inner wall of the bore 14 and end plates 16 and 17. These fluid chambers vary in volume, as viewed in FIG. 2, as the rotor 28 is rotated counterclockwise thereby providing the compressor action. The fluid chambers increase in volume in the left semi-cylindrical or inlet portion of the bore 14 and decrease in volume in the right semi-cylindrical or outlet portion of the bore 14. In this manner, a refrigerant or other working fluid introduced through the inlet orifice 51 into the bore 14 is compressively displaced out through the outlet orifices 53 upon counterclockwise rotation of the rotors 28. The working fluid introduced at the inlet port 47 is subjected to a suction force due to the increase in volume of the flid chambers in the inlet portion of the bore 14 and is sucked into the bore 14 through the inlet passageway 50 and inlet orifice 51. The working fluid is compressively displaced to the outlet orifices 53 as described above and forced to the outlet port 58 through the outlet passageway 52, passageway 57, oil separator 61 and outlet chamber 56.

Figure 3:
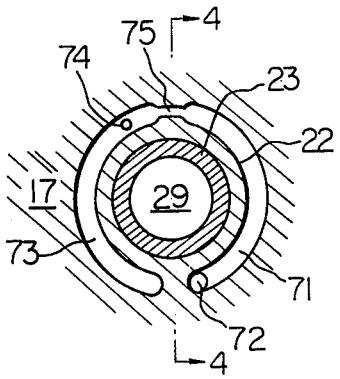
FIG. 3 is a fragmentary sectional view of the compressor shown in FIG. 1 taken on a line 3—3.
Figure 4:
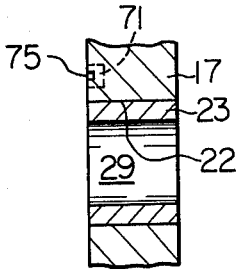
FIG. 4 is a fragmentary sectional view taken on a line 4—4 of FIG. 3.

Referring also to FIGS. 3 and 4, the face of the end plate 17 closing the bore 14 is formed with a high pressure oil groove 71 communicating with the oil sump 36 below an oil level 37 through an interconnecting passageway 72 and a low pressure oil groove 73 communicating with the oil chamber 48 through conducting passageway 74. A flow restriction groove 75 connects the grooves 71 and 73.

The grooves 71 and 73 are substantially semi-annular, with the high pressure oil grove 71 being provided in the outlet portion of the bore 14 and the low pressure oil groove 73 being provided in the inlet portion of the bore 14. The grooves 71 and 73 communicate with the slots 32 radially inwardly of the vanes 33.

The pressure of the working fluid in the outlet chamber 56 is applied to the oil sump 36 through the passageway 59 thereby pressurizing the sump 36. Pressurized oil is forced upwardly through the passageway 72 into the high pressure oil groove 71 and from the groove 71 into the inner portions of the slots 32 in the outlet portion of the bore 14 thereby urging the vanes 33 into sealing engagement with the inner wall of the bore 14 with a high force which is sufficient to overcome the radially inward force on the vanes 33 exerted by the compressed working fluid.

The flow restriction groove 75 provides a pressure drop between the high pressure oil groove 71 and the low pressure oil groove 73 so that the low pressure oil groove 73 is filled with oil but at a lower pressure than the high pressure oil groove 71. From the low pressure oil groove 73, oil flows into the slots 32 in the inlet portion of the bore 14 thereby urging the vanes 33 into engagement with the inner wall of the bore 14 with a force which is lower than in the outlet portion of the bore 14. The dimensions of the flow restriction passageway 75 are selected so that the pressure between the radially outer ends of the vanes 33 and the inner wall of the bore 14 is the same in the inlet and outlet portions of the bore 14.

From the low pressure oil groove 73, oil flows through the passageway 74 into the oil chamber 48, lubricating the bearings 23 and 26. Due to the low pressure in the inlet passageway 50, oil from the oil chamber 48 is sucked thereinto through the connecting passageway 55, mixed with working fluid sucked in through the inlet port 47 and introduced into the bore 14 through the inlet orifice 51. The oil in the bore 14 effectively lubricates the areas of sliding contact between the vanes 33 and the inner wall of the bore 14 and is discharged from the bore 14 into the outlet chamber 56 through the oil separator 61 which separates the oil from the working fluid. The working fluid is discharged through the outlet port 58 and the oil is returned to the oil sump 36 through the passageway 59.

With the radially inner portions of the slots 32 filled with oil, the pressure of the oil in the slots 32 depends on whether the slots 32 are in communication with the high pressure oil groove 71 or the low pressure oil groove 73. In this manner, the pressure in the slots 32 alternates between high and low in the outlet and inlet portions of the bore 14 as the slots 32 alternatingly communicate with the high pressure oil groove 71 and the low pressure oil groove 73 respectively. The oil in the inner portions of the slots 32 also serves to lubricate the areas of sliding contact between the vanes 33 and the walls of the slots 32.

In summary, it will be seen that the present invention overcomes the problem of unequal pressure between vanes and bore wall in inlet and outlet portions of the bore in a simple but novel manner. Many modifications to the particular embodiment shown and described within the scope of the invention will become possible for those skilled in the art after receiving the teachings of the present disclosure.

What is claimed is:

1. A rotary compressor comprising:

a housing formed with a bore and having end plates and an end cover;

a rotor comprising a rotor body and a shaft fixed to the rotor body, the rotor body being operatively disposed in the bore and being formed with a plurality of substantially radial slots, the shaft extending through the end cover;

a bearing mounted in an opening through one of the end plates and rotatably supporting the shaft;

a plurality of vanes slidably retained in the slots respectively for sealing engagement with an inner wall of the housing defining the bore thereby partitioning the bore into a plurality of fluid chambers, the rotor being disposed in the bore in such a manner that upon rotation thereof the fluid chambers increase in volume in an inlet portion of the bore and decrease in volume in an outlet portion of the bore;

a fluid inlet passageway opening into the inlet portion of the bore;

a fluid outlet passageway opening from the outlet portion of the bore;

an oil reservoir in said housing;

a communicating passageway between the oil reservoir and the fluid outlet passageway such that the fluid in the fluid outlet passageway pressurizes the oil reservoir;

a substantially semi-annular high pressure oil chamber formed in the housing and communicating with the slots of the rotor radially inwardly of the vanes in the outlet portion of the bore;

an interconnecting passageway between the high pressure oil chamber and the oil reservoir;

a substantially semi-annular low pressure oil chamber formed in the housing and communicating with the slots of the rotor radially inwardly of the vanes in the inlet portion of the bore;

a conducting passageway between the low pressure oil chamber and the fluid inlet passageway providing for flow of oil through the conducting passageway to the inlet portion of the bore, the bearing being located in the conducting passageway such that oil passing from the low pressure oil chamber to the fluid inlet passageway passes through the bearing to lubricate the latter, the conducting passageway being further formed by an oil chamber in the end cover disposed about the shaft; and a flow restriction passageway connecting the high pressure oil chamber with the low pressure oil chamber in such a manner that the vanes are pressed by oil in the slots of the rotor into sealing engagement with the wall of the bore with a high pressure in the outlet portion of the bore and with a low pressure in the inlet portion of the bore, the high and low pressure oil chambers and the flow restriction passageway being formed as grooves in the end plate which mounts the bearing.

2. A rotary compressor as in claim 1, further comprising another bearing in the end cover for rotatably rotating the rotor shaft, the last said bearing lubricated by the oil in the oil chamber.

* * * * *